US007910819B2

(12) United States Patent
Van De Par et al.

(10) Patent No.: US 7,910,819 B2
(45) Date of Patent: Mar. 22, 2011

(54) SELECTION OF TONAL COMPONENTS IN AN AUDIO SPECTRUM FOR HARMONIC AND KEY ANALYSIS

(75) Inventors: Steven Leonardus Josephus Van De Par, Goirle (NL); Martin Franciscus McKinney, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 178 days.

(21) Appl. No.: 12/296,583

(22) PCT Filed: Mar. 27, 2007

(86) PCT No.: PCT/IB2007/051067

§ 371 (c)(1), (2), (4) Date: Oct. 9, 2008

(87) PCT Pub. No.: WO2007/119182

PCT Pub. Date: Oct. 25, 2007

(65) Prior Publication Data

US 2009/0107321 A1 Apr. 30, 2009

Related U.S. Application Data

(60) Provisional application No. 60/792,390, filed on Apr. 14, 2006.

(51) Int. Cl.
*A63H 5/00* (2006.01)
*G04B 13/00* (2006.01)

(52) U.S. Cl. ..... 84/609; 84/613; 84/615; 84/616; 84/649; 84/653; 84/654

(58) Field of Classification Search ..... None
See application file for complete search history.

(56) References Cited

U.S. PATENT DOCUMENTS

| | | | | |
|---|---|---|---|---|
| 7,181,021 | B2 * | 2/2007 | Raptopoulos et al. | 381/71.14 |
| 2003/0026436 | A1 * | 2/2003 | Raptopoulos et al. | 381/71.4 |
| 2007/0291958 | A1 * | 12/2007 | Jehan | 381/103 |
| 2009/0107321 | A1 * | 4/2009 | Van De Par et al. | 84/613 |

FOREIGN PATENT DOCUMENTS

WO 2005122136 A1 12/2005

OTHER PUBLICATIONS

Steffen Pauws; "Musical Key Extraction From Audio", Proc. of the 5th International Conference on Music Information Retrieval, Barcelona, 2004, pp. 1-4, XP002447154.

Harte et al; "Automatic Chord Indentification Using a Quantised Chromagram", Paper 6412 118th Audio Engineering Society Convention, Barcelona, Spain, May 2005.

M. DeSainte-Catherine et al; "High-Precision Fourier Analysis of Sounds Using Signal Derivatives", J. Audio Eng. Soc., vol. 48, No. 7/8, pp. 654-667, Jul./Aug. 2000.

* cited by examiner

*Primary Examiner* — Marlon T Fletcher

(57) ABSTRACT

An audio signal is processed to extract key information by selecting (102) tonal components from the audio signal. A mask is then applied (104) to the selected tonal components to discard at least one tonal component. Note values of the remaining tonal components are determined (106) and mapped (108) to a single octave to obtain chroma values. The chroma values are accumulated (110) into a chromagram and evaluated (112).

15 Claims, 2 Drawing Sheets

SELECTION OF TONAL COMPONENTS IN AN AUDIO SPECTRUM FOR HARMONIC AND KEY ANALYSIS

Figure 1:
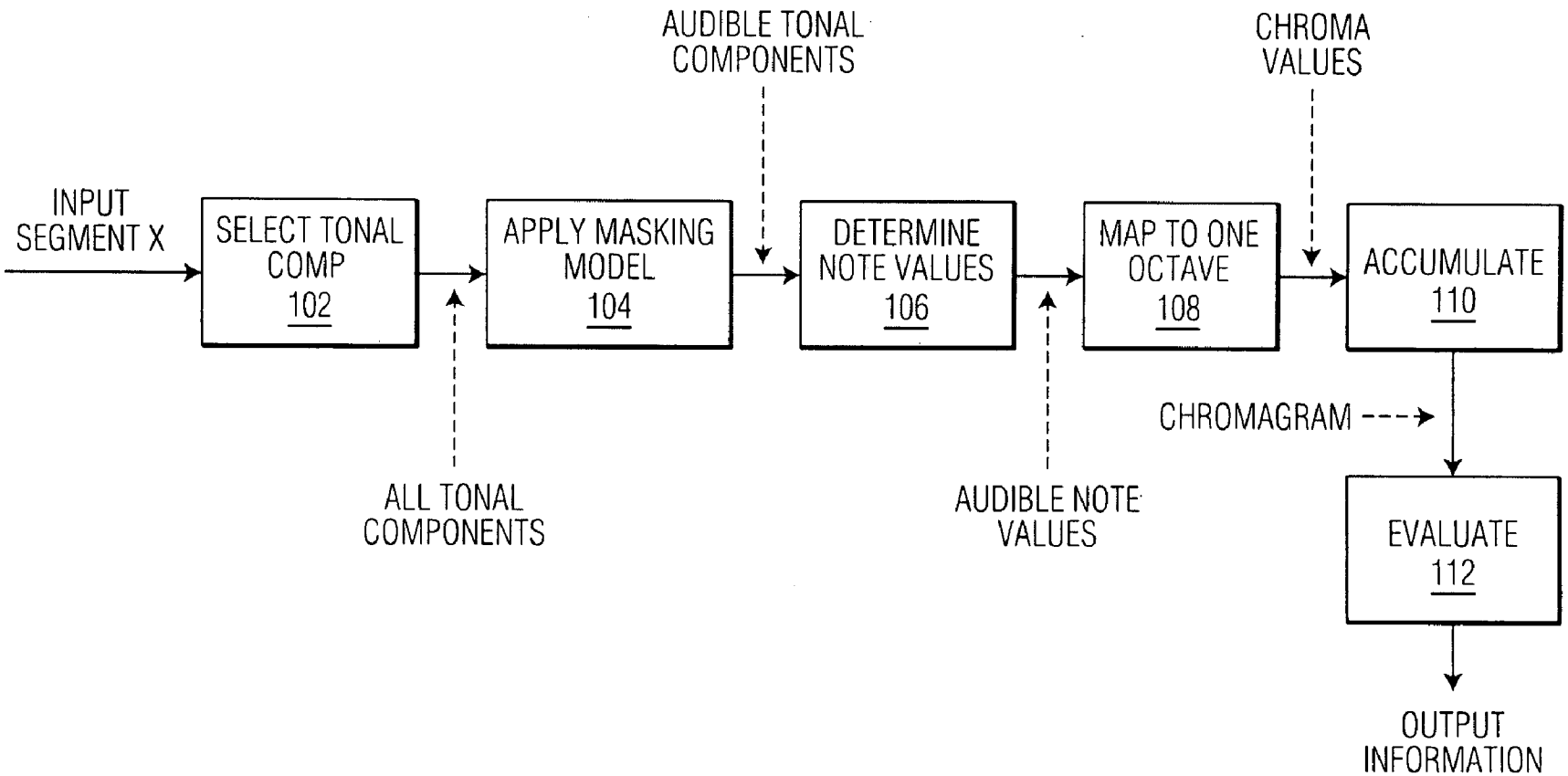

The present invention is directed to a selection of relevant tonal components in an audio spectrum in order to analyze the harmonic properties of the signal, such as the key signature of the input audio or the chord being played.

There is a growing interest in developing algorithms that evaluate audio content in order to classify the content according to a set of predetermined labels. Such labels can be the genre or style of music, the mood of music, the time period in which the music was released, etc. Such algorithms are based on retrieving features from the audio content that are processed by a trained model that can classify the content based on these features. The features extracted for this purpose need to reveal meaningful information that enables the model to perform its task. Features can be low-level, such as average power, but also more high-level features can be extracted, such as those based on psycho-acoustical insights, e.g., loudness, roughness, etc.

Among other things, the present invention is directed to features related to the tonal content of the audio. An almost universal component of music is the presence of tonal components that carry the melodic, harmonic, and key information. The analysis of this melodic, harmonic and key information is complex, because each single note that is produced by an instrument results in complex tonal components in the audio signal. Usually the components are 'harmonic' series with frequencies that are substantially integer multiples of the fundamental frequency of the note. When attempting to retrieve melodic, harmonic, or key information from an ensemble of notes that are played at a certain time, tonal components are found that coincide with the fundamental frequencies of the notes that were played plus a range of tonal components, the so-called overtones, that are integer multiples of the fundamental frequencies. In such a group of tonal components, it is very difficult to discriminate between fundamental components and components that are multiples of the fundamentals. In fact, it is possible that the fundamental component of one particular note coincides with an overtone of another note. As a consequence of the presence of the overtones, nearly every note name (A, A#, B, C, etc.) can be found in the spectrum at hand. This makes it rather difficult to retrieve information about the melodic, harmonic, and key properties of the audio signal at hand.

A typical representation of musical pitch—the perception of fundamental frequency—is in terms of its chroma, the pitch name within the Western musical octave (A, A-sharp, etc.). There are 12 different chroma values in the octave and any pitch can be assigned to one of these chroma values, which typically corresponds to the fundamental frequency of the note. Among other things, the present invention identifies as to which chroma(e) a particular note or set of notes belong, because the harmonic and tonal meaning of music is determined by the particular notes (i.e., chromae) being played. Because of the overtones associated with each note, a method is needed to disentangle the harmonics and identify only those which are important for identifying the chroma(e).

Some studies have been done that operate directly on PCM data. According to C. A. Harte and M. B. Sandler, "Automatic Chord Identification Using a Quantised Chromagram," Paper 6412 presented at the 118-th Audio Engineering Society Convention, Barcelona, May 2005 (hereinafter "Harte and Sandler"), a so-called chromagram extraction was used for automatic identification of chords in music. According to Harte and Sandler, a constant Q filterbank was used to obtain a spectrum representation from which the peaks were selected. For each peak, the note name was determined and the amplitudes of all peaks that had a corresponding note name were added resulting in a chromagram that indicated the prevalence of each note within the spectrum that was evaluated.

A limitation of this method is that for a single note being played, a large range of harmonics will generate peaks that are accumulated in the chromagram. For a C note, the higher harmonics will point to the following notes (C, G, C, E, G, A#, C, D, E, F#, G, G#). Especially the higher harmonics are densely populated and cover notes that have no obvious harmonic relation to the fundamental note. When accumulated in the chromagram, these higher harmonics can obscure the information that one intends to read from the chromagram, e.g. for chord identification or for extraction of the key of a song.

According to S. Pauws, "Musical Key Extraction for Audio," Proc. of the $5^{th}$ International Conference on Music Information Retrieval, Barcelona, 2004 (hereinafter "Paws"), chromagrams were extracted based on an FFT representation of short segments of input data. Zero padding and interpolation between spectral bins enhanced spectral resolution to a level that was sufficient for extracting frequencies of harmonic components from the spectrum. Some weighting was applied to components to put more emphasis on low-frequency components. However, the chromagram was accumulated in such a way that higher harmonics could obscure the information that one intended to read from the chromagram.

To overcome the problem that a measurement of tonal components will always be a mix of fundamental frequencies and multiples of these fundamental frequencies, according to the present invention auditory masking is used, such that the perceptual relevance of certain acoustic components is reduced through the masking influence of others.

Perceptual studies have shown that certain components (e.g., partials or overtones) are inaudible due to the masking influence of nearby partials. In the case of a harmonic tone complex, the fundamental and the first few harmonics can each be individually "heard out" because of the high auditory frequency resolution at low frequencies. However, the higher harmonics, which are the source of the above-mentioned chroma-extraction problem, cannot be "heard out" due the poor auditory frequency resolution at high frequencies and the presence of the other tonal components that serve as a masker. Thus, an auditory-processing model of masking serves well to eliminate the unwanted high-frequency components and improve the chroma extraction capabilities.

As stated above, a significant problem in conventional selections of relevant tonal components is that each note present in the audio creates a range of higher harmonics that can be interpreted as separate notes being played. Among other things, the present invention removes higher harmonics based on masking criteria, such that only the first few harmonics are kept. By converting these remaining components to a chromagram, a powerful representation of the essential harmonic structure of a segment of audio is obtained that allows, for example, an accurate determination of the key signature of a piece of music.

Figure 2:
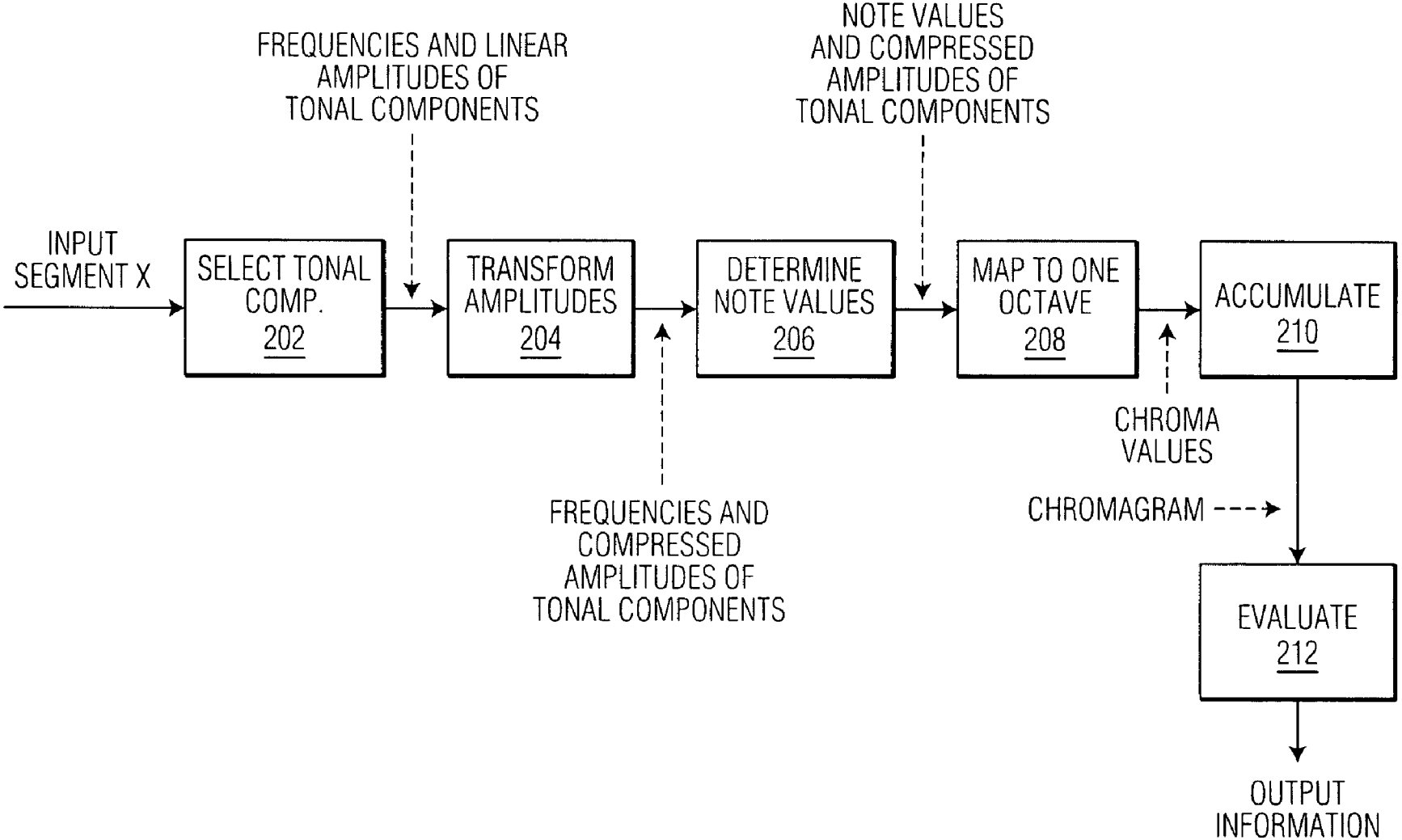

FIG. 1 shows a block diagram of a system according to one embodiment of the present invention; and FIG. 2 shows a block diagram of a system according to another embodiment of the present invention.

As illustrated in FIG. 1, in block 102 a selection unit performs the function of a tonal component selection. More specifically, tonal components are selected and non-tonal components are ignored from a segment of the audio signal illustrated as input signal x, using a modified version of M.

Desainte-Catherine and S. Marchand, "High-precision Fourier analysis of sounds using signal derivatives," *J. Audio Eng. Soc.*, vol. 48, no. 7/8, pp. 654-667, July/August 2000 (hereinafter "M. Desainte-Catherine and Marchand"). It is understood that the M. Desainte-Catherine and Marchand selection can be replaced by other methods, devices or systems to select tonal components.

In block 104 a mask unit discards tonal components based on masking. More specifically, those tonal components that are not audible individually are removed. The audibility of individual components is based on auditory masking.

In block 106 a label unit labels the remaining tonal components with a note value. Namely, the frequency of each component is translated to a note value. It is understood that note values are not limited to one octave.

In block 108 a mapping unit maps the tonal components, based on note values, to a single octave. This operation results in 'chroma' values.

In block 110 an accumulation unit accumulates chroma values in a histogram or chromagram. The chroma values across all components and across a number of segments are accumulated by creating a histogram counting the number of times a certain chroma value occurred, or by integrating amplitude values per chroma value into a chromagram. Both histogram and chromagram are associated with a certain time interval in the input signal across which the information has been accumulated.

In block 112 an evaluation unit performs a task dependent evaluation of the chromagram using a prototypical or reference chromagram. Depending on the task, a prototypical chromagram can be created and compared to the chromagram that was extracted from the audio under evaluation. When key extraction is performed, a key profile can be used as in, for example, Pauws by using key profiles as in, for example, Krumhansl, C. L., *Cognitive Foundations of Musical Pitch*, Oxford Psychological Series, no. 17, Oxford University Press, New York, 1990 (hereinafter "Krumhansl"). By comparing these key profiles to the mean chromagram extracted for a certain piece of music under evaluation, the key of that piece can be determined. Comparisons can be done by using a correlation function. Various other processing methods of the chromagram are possible depending on the task at hand.

It will be noted that after discarding the components based on masking, only the perceptually relevant tonal components are left. When a single note is considered, only the fundamental frequency components and the first few overtones will be left. Higher overtones will usually not be audible as individual components because several components fall within one auditory filter and the masking model will normally indicate these components as being masked. This will not be the case, e.g., when one of the higher overtones has a very high amplitude, as compared to the neighbouring components. In this case that component will not be masked. This is a desired effect because that component will stand out as a separate component that has musical significance. A similar effect will occur when multiple notes are played. The fundamental frequency of one of the notes may coincide with an overtone of one of the other notes. Only when this fundamental frequency component has sufficient amplitude as compared to the neighbouring components, it will be present after discarding the components based on masking. This is also a desired effect, because, only in this case the component will be audible and have musical significance. In addition, noisy components will tend to result in a very densely populated spectrum where individual components are typically masked by the neighbouring components and, as a consequence, these components will be discarded also by the masking. This is also desired because noise components do not contribute to the harmonic information in music.

After discarding the components based on masking, there will still be overtones left besides the fundamental tonal components. As a result, further evaluation steps will not be able to directly determine the notes that were played in the musical piece and to derive further information from these notes. However, the overtones that are present are only the first few overtones, which still have a meaningful harmonic relation to the fundamental tones.

The following representative example is for the task that the key is extracted of the audio signal under evaluation.

Tonal Component Selection

Two signals are used as input to the algorithm, the input signal, x(n), and the forward difference of the input signal, y(n)=x(n+1)−x(n). A corresponding segment is selected of both signals and windowed with a Hanning window. These signals are then transformed to the frequency domain using Fast Fourier Transform resulting in the complex signals: X(f) and Y(f), respectively.

The signal X(f) is used for selecting peaks, e.g. spectral values that have the local maximum absolute value. Peaks are only selected for the positive frequency part. Since the peaks can only be located at the bin values of the FFT spectrum, a relatively coarse spectral resolution is obtained which is not sufficiently good for our purposes. Therefore, the following step, according, for example, to Harte and Sandler, is applied: for each peak that was found in the spectrum the following ratio is calculated:

$$E(f) = \frac{N}{2\pi}\frac{Y(f)}{X(f)},$$

where N is the segment length and where E(f) signifies a more accurate frequency estimate of the peak found at location f. An additional step is applied to account for the fact that the method of Harte and Sandler is only suitable for continuous signals with differentials, and not for discrete signals with forward or backward differences. This shortcoming can be overcome by using a compensation:

$$F(f) = \frac{2\pi f E(f)}{(1 - \exp(2\pi i f / N))}.$$

Using this more accurate estimate for the frequency F, a set of tonal components is produced having frequency parameters (F) and amplitude parameters (A).

It will be noted that this frequency estimation is representing one possible embodiment only. Other methods for estimating frequencies are known to those skilled in the art.

Discarding Components Based on Masking

Based on the frequency and amplitude parameters that were estimated above, a masking model is used to discard components that are substantially inaudible. An excitation pattern is build up, by using a set of overlapping frequency bands with bandwidths equivalent to the ERB scale, and by integrating all the energy of the tonal components that fall within each band. The accumulated energies in each band are then smoothed across neighbouring bands to obtain a form of spectral spread of masking. For each component it is decided whether the energy of that component is at least a certain percentage of the total energy that was measured in that band, e.g. 50%. If the energy of a component is smaller than this criterion, it is assumed that it is substantially masked, and it will not be further taken into account.

It will be noted that this masking model is provided to get a very computationally efficient first order estimate of the masking effect that will be observed in audio. More advanced and accurate methods may be used.

Components are Labelled with a Note Value

The accurate frequency estimates that were obtained above are transformed to note values that signify, for example, that the component is an A in the $4^{th}$ octave. For this purpose the frequencies are transformed to a logarithmic scale and quantized in the proper way. An additional global frequency multiplication may be applied to overcome possible mistuning of the complete musical piece.

Components are Mapped to One Octave

All note values are collapsed into a single octave. So, the resulting chroma-values will only indicate that the note was an A or A#, irrespective of the octave placement.

Accumulation of Chroma Values in a Histogram or Chromagram

The chroma-values are accumulated by adding all amplitudes that correspond to an A, an A#, a B, etc. Thus, 12 accumulated chroma values will be obtained which resemble the relative dominance of each chroma value. These 12 values will be called the chromagram. The chromagram can be accumulated across all components within a frame, but preferably also across a range of consecutive frames.

Task Dependent Evaluation of the Chromagram Using a Key Profile

A focus is on the task of extracting key information. As stated above, a key profile can be obtained for data of Krumhansl in an analogue way as Pauws has done. Key extraction for an excerpt under evaluation is to find out how the observed chromagram needs to be shifted to obtain the best correlation between the prototypical (reference) chromagram and the observed chromagram.

These task dependent evaluations are only examples of how the information contained within the chromagram may be used. Other methods or algorithms may be used.

According to another embodiment of the present invention, in order to overcome the problem that very energetic components contribute too strongly to the chromagram, a compressive transformation is applied to the spectral components before they are mapped to one octave. In this way, components with a lower amplitude contribute relatively more strongly to the chromagram. A reduction in error rate of roughly by a factor of 4 (e.g. from 92% correct key classification to 98% on a classical data base) has been found according to this embodiment of the present invention.

In FIG. 2, a block diagram is provided for such embodiment of the present invention. In block 202 tonal components are selected from an input segment of audio (x) in selection unit. For each component, there is a frequency value and a linear amplitude value. Then, in block 204 a compressive transform is applied to the linear amplitude values in compressive transform unit. In block 206 the note values of each frequency are then determined in label unit. The note value indicates the note name (e.g. C, C#, D, D#, etc.) and the octave in which the note is placed. In block 208 all note amplitude values are transformed to one octave in mapping unit, and in block 210 all transformed amplitude values are added in accumulation unit. As the result, a 12-value chromagram is obtained. In block 212 the chromagram is then used to evaluate some property of the input segment, e.g. key, in evaluation unit.

One compressive transformation—the dB scale approximates human perception of loudness—is given by:

$$y=20\log_{10}x$$

where x is the input amplitude that is transformed, and y is the transformed output. Typically, this transformation is performed on the amplitudes that are derived for the spectral peaks for the total spectrum just before the spectrum is mapped onto a one-octave interval.

It will be appreciated that in the above description each processing unit may be implemented in hardware, software or combination thereof. Each processing unit may be implemented on the basis of at least one processor or programmable controller. Alternatively, all processing units in combination may be implemented on the basis of at least one processor or programmable controller.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment but rather construed in breadth and scope in accordance with the appended claims.

What is claimed is:

1. A method of processing an audio signal, said method comprising the steps of:

selecting tonal components from the audio signal;

applying a mask to the selected tonal components to discard at least one tonal component;

determining note values of the tonal components remaining after discarding;

mapping the note values to a single octave to obtain chroma values;

accumulating the chroma values into a chromagram; and evaluating the chromagram.

2. The method as claimed in claim 1, wherein the tonal components are selected by transforming the audio signal into a frequency domain, each of the tonal components being represented by a frequency value and an amplitude value.

3. The method as claimed in claim 2, wherein the amplitude value is compressively transformed based on human perception of loudness.

4. The method as claimed in claim 1, wherein the mask is applied to discard substantially inaudible tonal components based on a threshold value.

5. The method as claimed in claim 1, wherein the chromagram is evaluated by comparing the chromagram with a reference chromagram to extract key information from the audio signal.

6. A device for processing an audio signal, comprising:

a selection unit for selecting tonal components from the audio signal;

a mask unit for applying a mask to the selected tonal components to discard at least one tonal component;

a label unit for determining note values of the tonal components remaining after discarding;

a mapping unit for mapping the note values to a single octave to obtain chroma values;

an accumulation unit for accumulating the chroma values into a chromagram; and an evaluation unit for evaluating the chromagram.

7. The device as claimed in claim 6, wherein the tonal components are selected by transforming the audio signal into a frequency domain, each of the tonal components being represented by a frequency value and an amplitude value.

8. The device as claimed in claim 7, further comprising a compressive transform unit for compressively transforming the amplitude value based on human perception of loudness.

9. The device as claimed in claim 6, wherein the mask is applied to discard substantially inaudible tonal components based on a threshold value.

10. The device as claimed in claim 6, wherein the chromagram is evaluated by comparing the chromagram with a reference chromagram to extract key information from the audio signal.

11. A software program, embedded in a computer readable medium, when executed by a processor for carrying out the acts, comprising:

selecting tonal components from the audio signal;

applying a mask to the selected tonal components to discard at least one tonal component;

determining note values of the tonal components remaining after discarding;

mapping the note values to a single octave to obtain chroma values;

accumulating the chroma values into a chromagram; and evaluating the chromagram.

12. The program as claimed in claim 11, wherein the tonal components are selected by transforming the audio signal into a frequency domain, each of the tonal components being represented by a frequency value and an amplitude value.

13. The program as claimed in claim 12, wherein the amplitude value is compressively transformed (204) based on human perception of loudness.

14. The program as claimed in claim 11, wherein the mask is applied to discard substantially inaudible tonal components based on a threshold value.

15. The program as claimed in claim 11, wherein the chromagram is evaluated by comparing the chromagram with a reference chromagram to extract key information from the audio signal.

* * * * *